US010005087B2

(12) United States Patent
Tatsumi et al.

(10) Patent No.: US 10,005,087 B2
(45) Date of Patent: Jun. 26, 2018

(54) PARTICLE COLLECTOR SYSTEM AND DUST COLLECTION METHOD

(71) Applicant: CREATIVE TECHNOLOGY CORPORATION, Kawasaki-shi, Kanagawa (JP)

(72) Inventors: Yoshiaki Tatsumi, Kawasaki (JP); Yu Saito, Kawasaki (JP); Toshifumi Sugawara, Kawasaki (JP)

(73) Assignee: CREATIVE TECHNOLOGY CORPORATION, Kawasaki-shi (JP)

( * ) Notice: Subject to any disclaimer, the term of this patent is extended or adjusted under 35 U.S.C. 154(b) by 71 days.

(21) Appl. No.: 14/915,335

(22) PCT Filed: Aug. 2, 2014

(86) PCT No.: PCT/JP2014/070406
§ 371 (c)(1),
(2) Date: Feb. 29, 2016

(87) PCT Pub. No.: WO2015/029698
PCT Pub. Date: Mar. 5, 2015

(65) Prior Publication Data

US 2016/0207051 A1 Jul. 21, 2016

(30) Foreign Application Priority Data

Sep. 2, 2013 (JP) ..... 2013-181593

(51) Int. Cl.
*B03C 3/47* (2006.01)
*B03C 3/49* (2006.01)
(Continued)

(52) U.S. Cl.
CPC ..... *B03C 3/47* (2013.01); *B03C 3/06* (2013.01); *B03C 3/41* (2013.01); *B03C 3/49* (2013.01);
(Continued)

(58) Field of Classification Search
CPC combination set(s) only.
See application file for complete search history.

(56) References Cited

U.S. PATENT DOCUMENTS 3,837,145 A * 9/1974 Festner ..... B03C 3/47 160/330
4,155,792 A * 5/1979 Gelhaar ..... B03C 3/64 156/172
(Continued)

FOREIGN PATENT DOCUMENTS

CN 1604270 A 4/2005
CN 102160275 A 8/2011
(Continued)

OTHER PUBLICATIONS

Office Action dated Oct. 17, 2016, issued in counterpart Chinese Patent Application No. 201480045587.6, with English translation. (19 pages).
(Continued)

*Primary Examiner* — Robert A Hopkins
*Assistant Examiner* — Sonji Turner
(74) *Attorney, Agent, or Firm* — Westerman, Hattori, Daniels & Adrian, LLP

(57) ABSTRACT

A particle collector system includes a dust collection unit, a power source unit, and a capacitance measurement unit. The dust collection unit includes first and second electrodes, a second electrode, and a dielectric body covering the electrodes. The power source unit supplies power source voltage to the first and second electrodes. The capacitance measurement unit measures the capacitance between the first and second electrodes. With this particle collector system and dust collection method using it, particles can be almost completely removed without periodic performance of a particle removal operation.

4 Claims, 8 Drawing Sheets

(51) Int. Cl.
*B03C 3/68* (2006.01)
*B03C 3/06* (2006.01)
*B03C 3/41* (2006.01)

(52) U.S. Cl.
CPC ..... *B03C 3/68* (2013.01); *B03C 2201/24* (2013.01); *B03C 2201/32* (2013.01)

(56) References Cited

U.S. PATENT DOCUMENTS

| | | | | |
|---|---|---|---|---|
| 4,944,778 | A * | 7/1990 | Yanagawa | B03C 3/155 96/66 |
| 5,542,964 | A * | 8/1996 | Kroeger | B03C 3/68 323/903 |
| 7,431,755 | B2 * | 10/2008 | Kobayashi | B03C 3/08 96/69 |
| 8,366,813 | B2 * | 2/2013 | Tokuda | G01N 15/0656 55/282.3 |
| 8,506,674 | B1 * | 8/2013 | Brown-Fitzpatrick | B03C 3/68 700/273 |
| 2005/0039773 | A1 | 2/2005 | Moriya et al. | |
| 2007/0028767 | A1 * | 2/2007 | Choi | B01D 39/1692 95/59 |
| 2008/0017030 | A1 * | 1/2008 | Fleck | B03C 3/68 95/81 |
| 2009/0173684 | A1 | 7/2009 | Tryti et al. | |
| 2011/0162526 | A1 * | 7/2011 | Tatsumi | A01G 7/04 96/58 |
| 2012/0085230 | A1 * | 4/2012 | Akdim | B03C 3/017 95/6 |

FOREIGN PATENT DOCUMENTS

| | | | |
|---|---|---|---|
| DE | 26 41 114 | A1 | 3/1978 |
| EP | 2 339 741 | A1 | 6/2011 |
| JP | 53-36081 | A | 4/1978 |
| JP | 54-51074 | A | 4/1979 |
| JP | 55-141561 | U | 10/1980 |
| JP | 8-222353 | A | 8/1996 |
| JP | 8-229432 | A | 9/1996 |
| JP | 2000-488 | A | 1/2000 |
| JP | 2005-72175 | A | 3/2005 |
| JP | 2006-149156 | A | 6/2006 |
| JP | 2009-23020 | A | 2/2009 |
| JP | 2009-90205 | A | 4/2009 |
| JP | 2010-264341 | A | 11/2010 |
| WO | 2007/135506 | A1 | 11/2007 |
| WO | 2010/032676 | A1 | 3/2010 |

OTHER PUBLICATIONS

International Search Report dated Nov. 4, 2014, issued in counterpart Application No. PCT/JP2014/070406 (2 pages).

Office Action dated Mar. 5, 2018, issued in counterpart Japanese Application No. 2015-534109, with English machine translation. (9 pages).

* cited by examiner

[ FIG. 1]
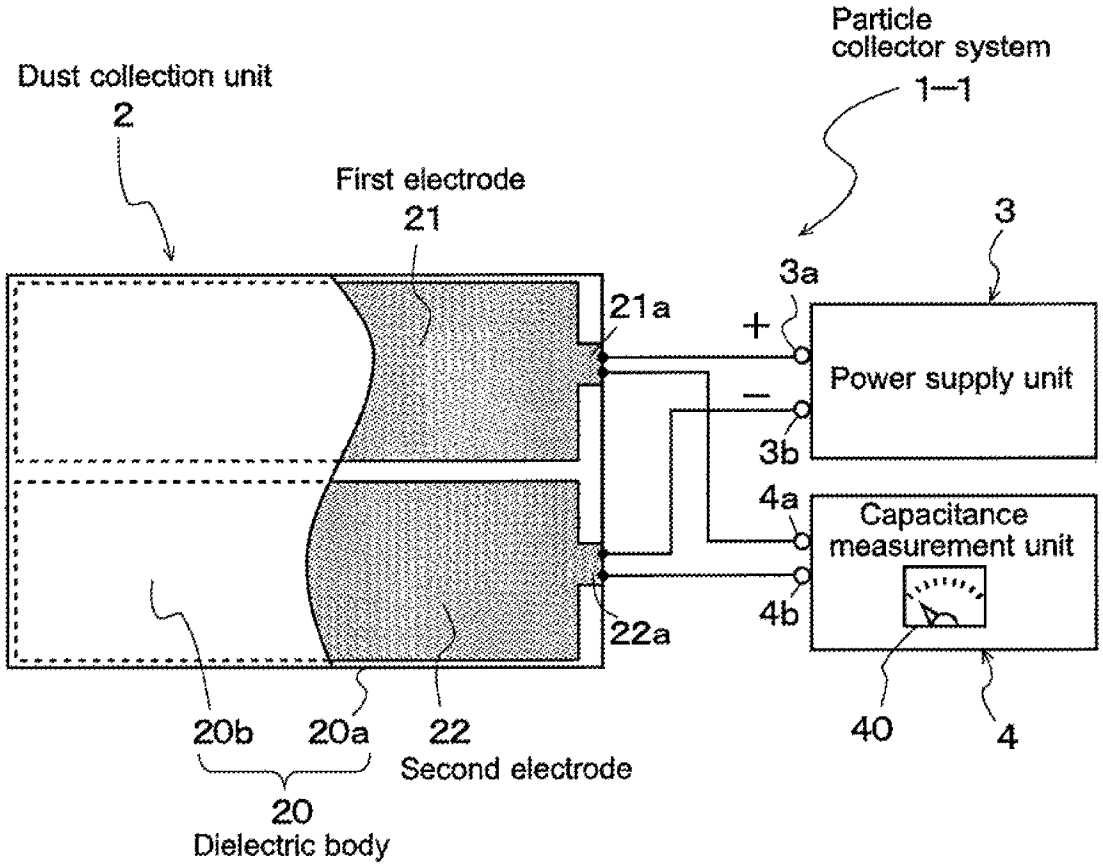

[ FIG. 2]
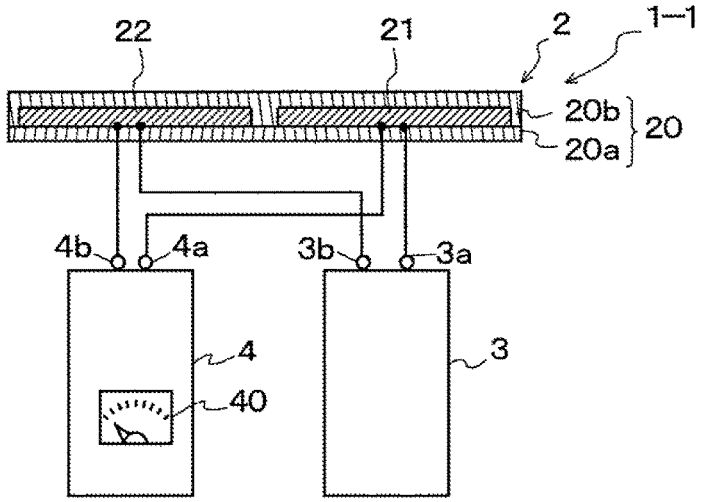
[ FIG. 3]
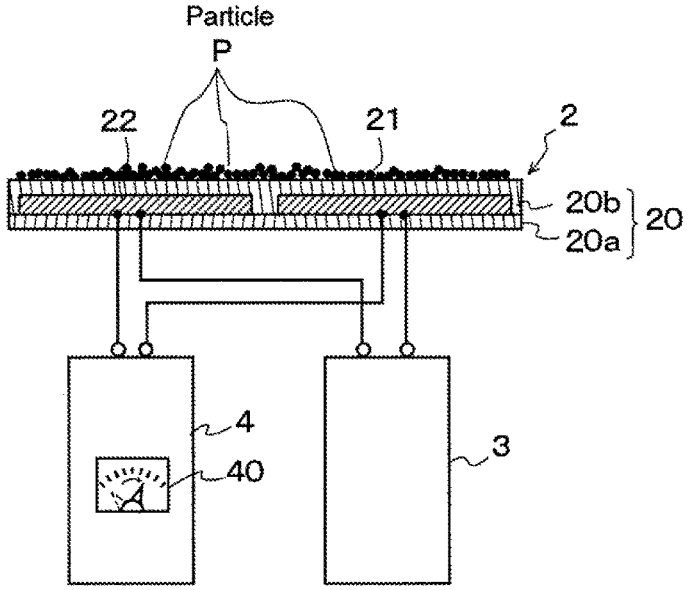

[ FIG. 4]
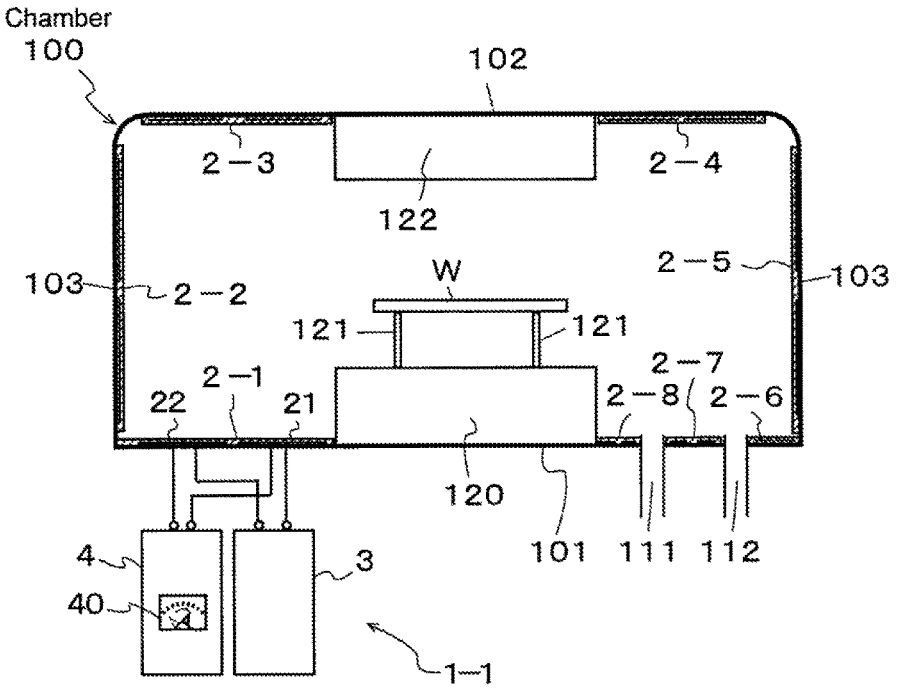

[ FIG. 5]
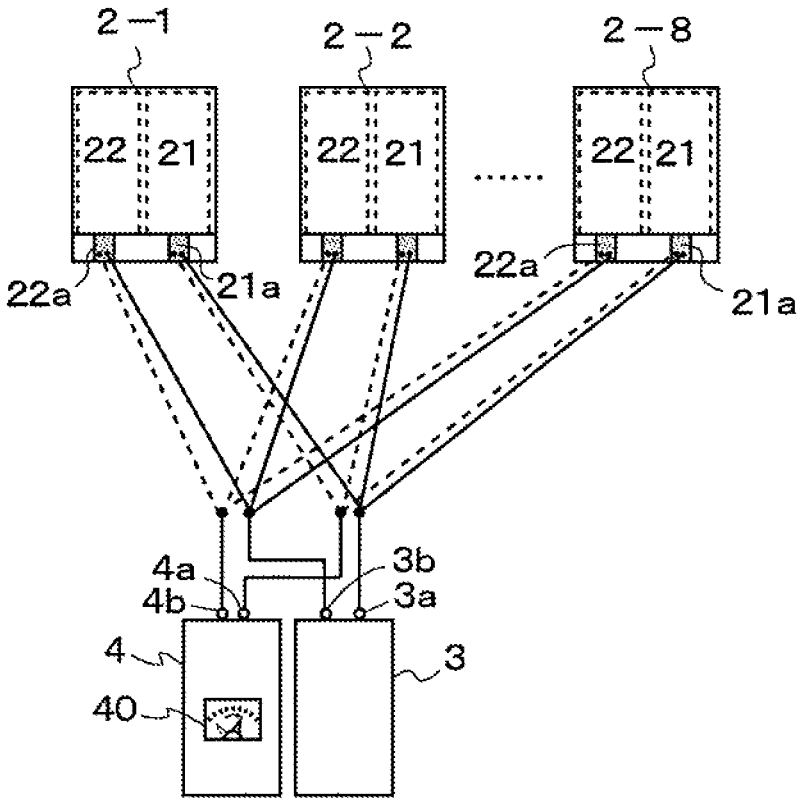

[FIG. 6]
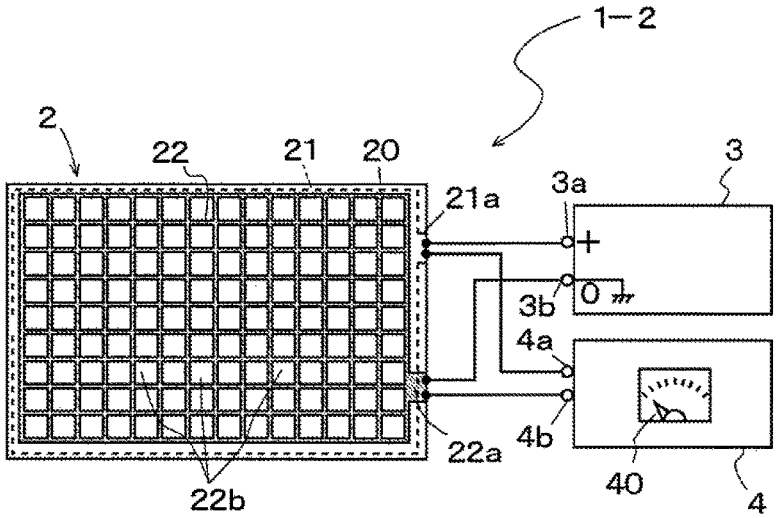
[ FIG. 7]
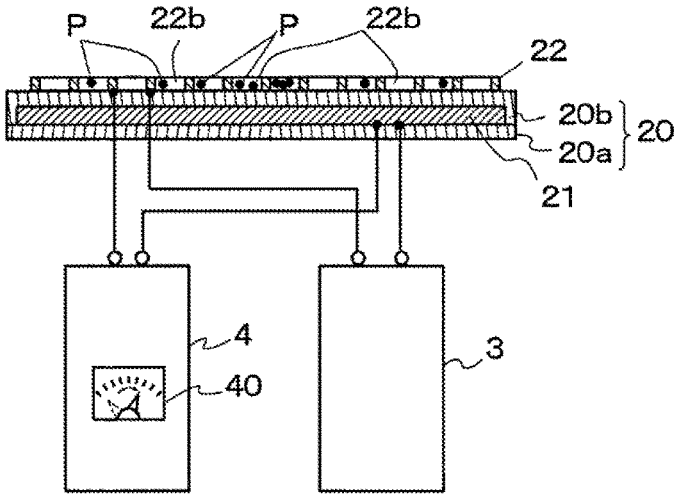

[ FIG. 8]
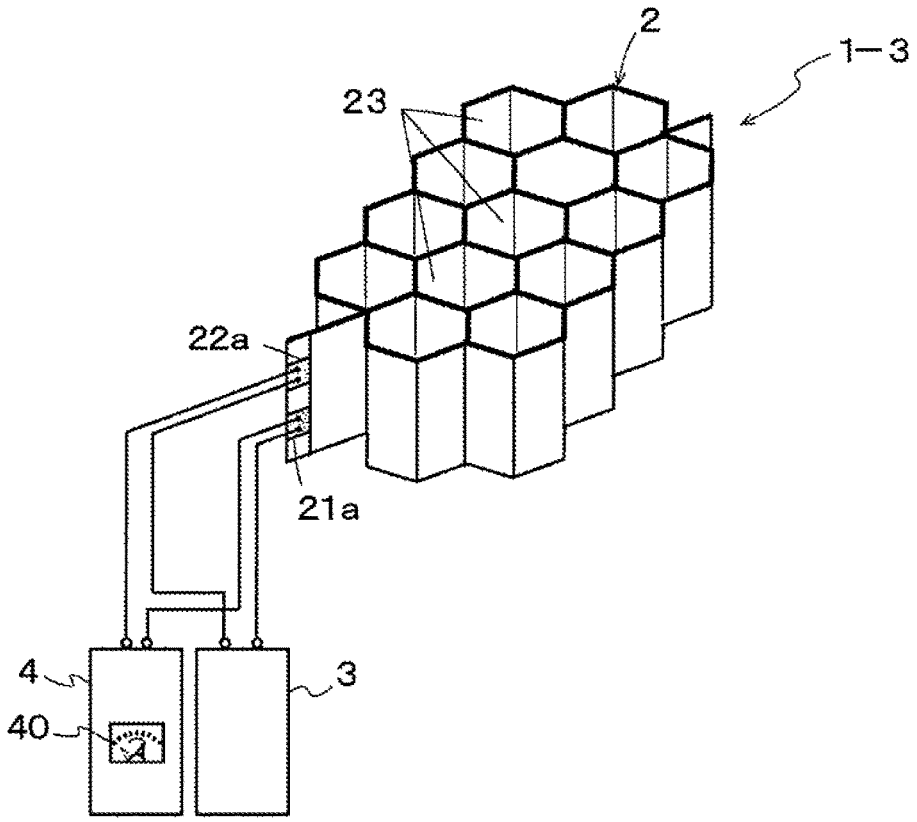

[ FIG. 9]
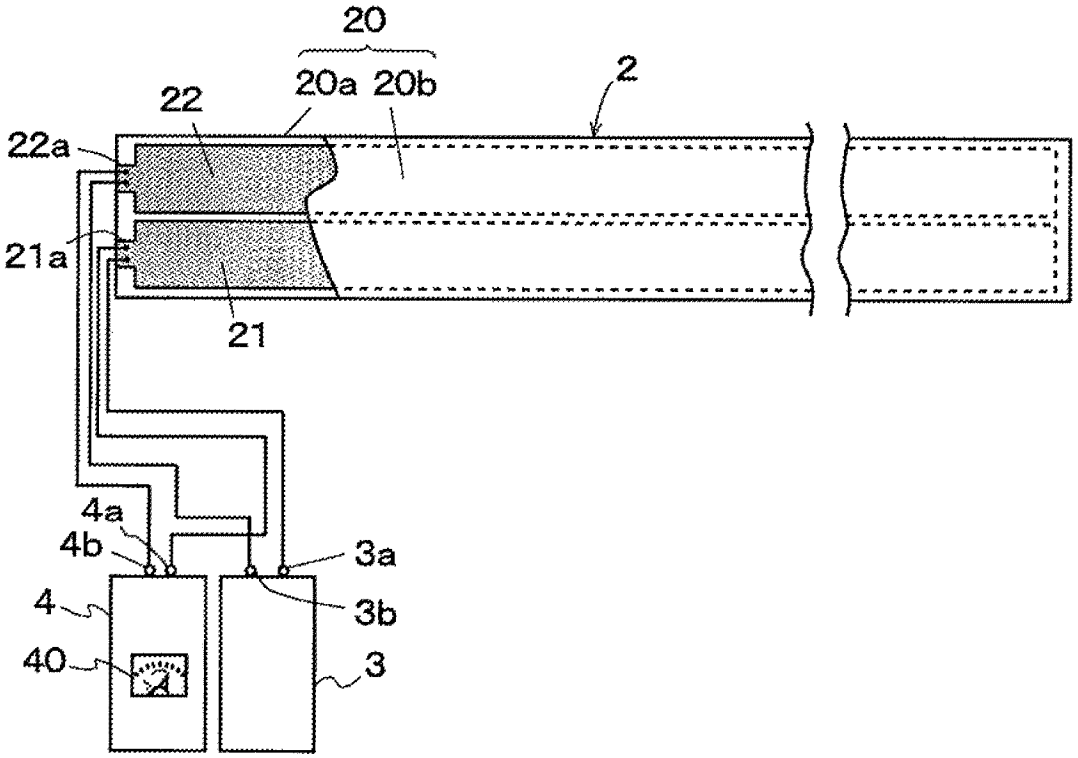

[ FIG. 10]
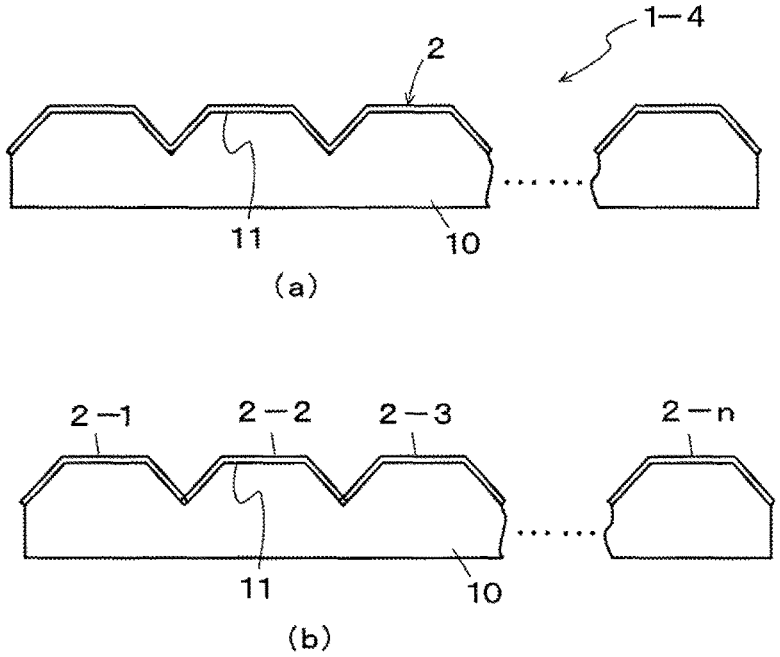
[ FIG. 11]
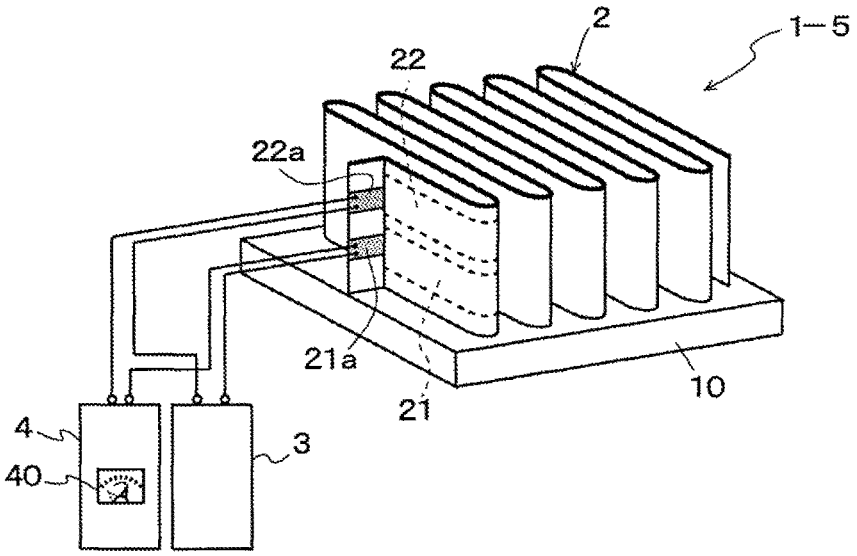

PARTICLE COLLECTOR SYSTEM AND DUST COLLECTION METHOD

TECHNICAL FIELD

The present invention relates to a particle collector system and a dust collection method to collect dust by attracting particles (foreign matter) that become a problem in the process of manufacturing a semiconductor or a liquid crystal display.

BACKGROUND ART

In the process of manufacturing a semiconductor or a display, in order to minimize particles that cause a defective mode, particular care must be taken with regard to a dust collection and dust proofing design thereof.

As a dust collection and dust proofing method, the following methods are conventionally adopted (for example, refer to Patent Literature 1 and Patent Literature 2, etc.).

As a first method, a layout design of drive parts is devised.

In detail, drive parts and sliding parts that become a generation source of particles are removed from an area immediately above a work to minimize generation of particles that drop down on the work.

As a second method, selection of a material system is devised.

In detail, upon focusing on the fact that abrasion of materials to be used for drive parts and sliding parts causes generation of particles, generation of particles is suppressed by selecting materials which have abrasion resistance and which are not brittle.

As a third method, scattering paths of generated particles are blocked or changed.

In detail, by providing a cover or a sill at a portion at which particles are inevitably generated, a structure in which generated particles do not directly attach to a work is obtained. Alternatively, by repeating vacuum/atmosphere releasing inside the chamber, particles are frequently discharged to the outside.

As a fourth method, a structure to prevent particles from being thrown up is configured.

In detail, in the case of vacuuming, gas introduction, etc., inside the chamber, particles being thrown up with the introduction of air becomes a problem, so that the introduced air is changed into clean air by using a filter, or a trap part is provided in an air introduction passage to clean the air.

CITATION LIST

Patent Literature

PLT 1: Japanese Application Laid-Open No. 2009-023020
PLT 2: Japanese Application Laid-Open No. 2010-264341

SUMMARY OF THE INVENTION

Technical Problem

However, the foregoing conventional techniques have the following problems.

With the foregoing dust collection and dust proofing methods, particles that are brought-in from the outside together with a work and particles that are generated at drive parts in a chamber inside a device can be reduced, however, they cannot be completely eliminated. In particular, particles accumulating at side wall portions and a floor portion of a chamber inside a device are stirred up by a wind pressure of air that has been blown into the chamber at once, and scatter throughout the inside of the chamber.

Even by adopting the above-described dust collection and dust proofing methods, these factors lead to a situation where particles inevitably accumulate inside the chamber. Therefore, conventionally, an operation to remove accumulated particles needs to be periodically performed, and such maintenance costs are high. During maintenance, the manufacturing operation must be interrupted for a long period of time, and this causes a lowering in production efficiency.

The present invention was made to solve the foregoing problems, and accordingly an object thereof is to provide a particle collector system and a dust collection method by which particles can be almost completely removed without periodically performing a particle removal operation.

Solution to the Problems

In order to solve the foregoing problems, one aspect of the invention is a particle collector system including a sheet-shaped and flexible dust collection unit to attract particles by an electrostatic force, a power supply unit to supply power to the dust collection unit to generate an electrostatic force, and a capacitance measurement unit to measure a capacitance of the dust collection unit which varies according to an attraction amount of particles attracted to the dust collection unit. The dust collection unit includes a first electrode, a second electrode disposed near the first electrode, and a dielectric body that covers at least the entire first electrode. The power supply unit supplies predetermined power source voltages to the first and second electrodes. The capacitance measurement unit measures a capacitance between the first and second electrodes.

With this configuration, when predetermined power source voltages are supplied from the power supply unit to the first and second electrodes, the first and second electrodes generate an electrostatic force, and particles are attracted to the surface of the dielectric body. At this time, the particle attraction force can be controlled by adjusting the power source voltages.

By adjusting the power source voltages and maintaining the particle attraction force at a desired value, particles are attracted to the dust collection unit and accumulate with time. Then, the capacitance between the first and second electrodes varies according to the accumulation amount of particles attracted to the dust collection unit. At this time, the capacitance between the first and second electrodes can be monitored by being measured with the capacitance measurement unit, so that when the accumulation amount becomes larger than a reference value, the supply of the power source voltages from the power supply unit is stopped and the particles attracted to the dust collection unit can be disposed of at a predetermined location.

Another aspect of the invention is the particle collector system mentioned above, wherein the dust collection unit is formed by horizontally juxtaposing the first and second electrodes, and entirely covering the first and second electrodes by the dielectric body.

With this configuration, particles are attracted to the surface of the dielectric body covering the entirety of the first and second electrodes.

Yet another aspect of the invention is the particle collector system mentioned above, wherein the dust collection unit is formed by covering the entire first electrode by the dielectric body and affixing the meshed second electrode to the surface of the dielectric body.

With this configuration, particles are attracted by an electrostatic force of the first and second electrodes, and captured inside the meshes of the meshed second electrode. That is, the particle collector system according to this invention electrically and mechanically captures particles, so that its particle capturing performance is high.

A further aspect of the invention is the particle collector system mentioned above, wherein the dust collection unit is formed into a belt shape by covering the juxtaposed long-length first and second electrodes by the dielectric body, and this dust collection unit is folded into a honeycomb shape.

With this configuration, the dust collection unit is formed into a three-dimensional shape, and its particle attraction area becomes larger.

Another aspect of the invention is the particle collector system mentioned above, wherein the dust collection unit is affixed to the entire surface of a base material having a wavelike surface.

With this configuration, the surface of the dust collection unit is wavelike, and its particle attraction area becomes larger.

Yet another aspect of the invention is the particle collector system mentioned above, wherein the dust collection unit is formed into a belt shape by covering the juxtaposed long-length first and second electrodes by the dielectric body, and the dust collection unit is folded into a meandering shape and erected on a base material.

A dust collection method is configured so that all of the portions to which other members are not attached among a floor portion, wall portions, and a ceiling portion inside a chamber are laid with the dust collection unit applied to the particle collector system. The power supply unit and the capacitance measurement unit are disposed outside the chamber, and particles inside the chamber are collected.

With this configuration, particles accumulating on wall portions and a floor portion, etc., inside a chamber are attracted and collected by the dust collection unit with which these portions are laid. Therefore, when air is introduced into the chamber from the outside, particles can be prevented from being stirred up by a wind pressure of the air that blew into the chamber at a time and scattering throughout the inside of the chamber. The capacitance measurement unit is monitored, and when it is judged that particles have exceeded a reference value, the power supply is turned off and the particles attached to the dust collection unit can be removed. That is, only when necessary, a particle removal operation needs to be performed, and therefore, a maintenance operation does not need to be periodically performed. As a result, maintenance costs can be reduced and production efficiency can be improved.

Effects of the Invention

As described above in detail, according to the present invention, particles near the dust collection unit can be almost completely attracted. Then, while a state of particle collection is monitored by the capacitance measurement unit, only when necessary, particles are removed from the dust collection unit, and therefore, a particle removal operation does not need to be periodically performed, and this brings about excellent effects including reduction in maintenance costs and improvement in production efficiency.

BRIEF DESCRIPTION OF THE DRAWINGS

FIG. 1 is a configuration diagram of a particle collector system according to a first embodiment of the present invention.

FIG. 2 is a configuration diagram of the particle collector system, showing a dust collection unit in section.

FIG. 3 is a sectional view for describing a function of the particle collector system.

FIG. 4 is a schematic view showing a chamber using the particle collector system.

FIG. 5 is a schematic plan view showing states of connection between the dust collection unit and the power supply unit, the capacitance measurement unit.

FIG. 6 is a configuration diagram showing a particle collector system according to a second embodiment of the present invention.

FIG. 7 is a sectional view for describing a function of the particle collector system.

FIG. 8 is a configuration diagram showing a particle collector system according to a third embodiment of the present invention.

FIG. 9 is a plan view showing a state where a dust collection unit is developed.

FIG. 10 are schematic views showing a dust collection unit as an essential portion of a particle collector system according to a fourth embodiment of the present invention.

FIG. 11 is a configuration diagram of a particle collector system according to a fifth embodiment of the present invention.

DESCRIPTION OF THE EMBODIMENTS

Hereinafter, the best mode of the present invention will be described with reference to the drawings.

First Embodiment

FIG. 1 is a configuration diagram of a particle collector system according to a first embodiment of the present invention, showing a dust collection unit partially broken. FIG. 2 is a configuration diagram of the particle collector system, showing the dust collection unit in section.

As shown in FIG. 1 and FIG. 2, this particle collector system 1-1 includes a dust collection unit 2, a power supply unit 3, and a capacitance measurement unit 4.

The dust collection unit 2 is a portion to attract particles by an electrostatic force, and is made of a sheet-shaped flexible material, and includes a first electrode 21, a second electrode 22, and a dielectric body that covers the entirety of these first and second electrodes 21 and 22.

The dielectric body 20 is formed of a lower layer resin sheet 20*a* and an upper layer resin sheet 20*b*. The first electrode 21 and the second electrode 22 are disposed close to each other so as to be horizontally juxtaposed on the lower layer resin sheet 20*a*, and the upper layer resin sheet 20*b* is affixed onto the lower layer resin sheet 20*a* so as to cover the entirety of the first and second electrodes 21 and 22.

The power supply unit 3 is a portion to supply power to the dust collection unit 2 to generate an electrostatic force.

In detail, as shown in FIG. 1, an input and output terminal 3*a* of the power supply unit 3 is connected to a terminal 21*a* of the first electrode 21, and an input and output terminal 3*b* is connected to a terminal 22*a* of the second electrode 22.

Accordingly, by turning the power supply unit 3 on, voltages with polarities opposite to each other are applied to the first and second electrodes 21 and 22, respectively. In the present embodiment, for example, a voltage of +0.2 kV to 5.0 kV is applied to the first electrode 21, and a voltage with an opposite polarity of −0.2 kV to −5.0 kV is applied to the second electrode 22.

The capacitance measurement unit 4 is a portion to measure a capacitance of the dust collection unit 2.

In detail, a detection terminal 4*a* of the capacitance measurement unit 4 is connected to the terminal 21*a* of the first electrode 21, and a detection terminal 4*b* is connected to the terminal 22*a* of the second electrode 22.

Accordingly, by the capacitance measurement unit 4, a capacitance between the first and second electrodes 21 and 22 can be measured. This capacitance varies according to an attraction amount of particles attracted to the dust collection unit 2, so that by monitoring a capacitance value on a display unit 40, how much particles have currently accumulated in the dust collection unit 2 can be visually confirmed.

Here, a function of the particle collector system 1-1 will be described.

FIG. 3 is a sectional view for describing the function of the particle collector system 1-1.

As shown in FIG. 3, when the power supply unit 3 is turned on, predetermined power source voltages are supplied from the power supply unit 3 to the first and second electrodes 21 and 22, and by an electrostatic force generated in the first and second electrodes 21 and 22, particles P are attracted to the surface, etc., of the dielectric body 20.

At this time, the attraction force of the first and second electrodes 21 and 22 to be applied to the particles P corresponds to the magnitudes of the power source voltages of the power supply unit 3, so that by adjusting the power source voltages to be supplied from the power supply unit 3, the attraction force to be applied to the particles P can be controlled.

When the attraction force to be applied to the particles P is maintained at a desired value by adjusting the power source voltages of the power supply unit 3, particles P are attracted to the dust collection unit 2 by an electrostatic force of the first and second electrodes 21 and 22, and accumulate little by little.

The capacitance between the first and second electrodes 21 and 22, that is, the capacitance of the dust collection unit 2 varies according to an accumulation amount of particles P attracted to the dust collection unit 2, so that by monitoring the display unit 40 of the capacitance measurement unit 4, a current accumulation amount can be known.

Therefore, when it is visually confirmed that the accumulation amount of particles P has become larger than a reference value on the display unit 40 of the capacitance measurement unit 4, the supply of the power source voltages from the power supply unit 3 is stopped by turning the power supply unit 3 off. Accordingly, particles P attracted to the dust collection unit 2 can be removed from the dust collection unit 2 and disposed of at a predetermined location.

Next, a usage example of the particle collector system of the present embodiment will be described.

This usage example embodies a dust collection method according to the present invention.

FIG. 4 is a schematic view showing a chamber using the particle collector system 1-1, and FIG. 5 is a schematic plan view showing states of connection between dust collection units 2-1 to 2-8 and the power supply unit 3, the capacitance measurement unit 4.

The chamber 100 shown in FIG. 4 is a chamber used for a semiconductor manufacturing device and a liquid crystal display manufacturing device, etc., and has an introduction port 111 for introducing gaseous bodies such as air and gases, etc., and an exhaust port 112 for exhaust on a floor portion 101.

On this floor portion 101, a stage 120 as another member is installed, and a work W is supported by lift pins 121 and 121 on the stage 120. On a ceiling portion 102 just above the work W, an upper device 122 for etching and exposure is installed.

Generally, in this chamber 100, by using materials with abrasion resistance for the stage 102 and the upper device 122, generation of particles (not shown) from the device itself is suppressed, and by attaching a cover, dropping down of particles to the work W, etc., are prevented. Further, by attaching a filter to the introduction port 111, air, etc., to be introduced is purified.

However, even by adopting such dust collection and dust proofing methods, in actuality, particles cannot be completely eliminated, and accumulate on the floor portion 101, etc., of the chamber 100.

Therefore, in the dust collection method of this example, by using the particle collector system 1-1 for the chamber 100, an almost complete dust collection and dust proofing effect is obtained.

In detail, all of the portions to which the stage 120 and the upper device 122, etc., as other members are not attached among the floor portion 101, the wall portions 103, and the ceiling portion 102 inside the chamber 100 are laid with a number of dust collection units 2-1 to 2-8. Then, as shown in FIG. 5, the dust collection units 2-1 to 2-8 are connected in parallel to the power supply unit 3 and the capacitance measurement unit 4. In detail, as shown by the solid lines in FIG. 5, all first electrodes 21 of the dust collection units 2-1 to 2-8 are connected to the input and output terminal 3*a* of the power supply unit 3, and all second electrodes 22 are connected to the input and output terminal 3*b*. As shown by the dashed lines in FIG. 5, all first electrodes 21 of the dust collection units 2-1 to 2-8 are connected to the detection terminal 4*a* of the capacitance measurement unit 4, and all second electrodes 22 are connected to the detection terminal 4*b*.

Thus, by laying a number of dust collection units 2-1 to 2-8 on the floor portion 101, etc., inside the chamber 100, particles scattering on the floor portion 101, etc., are attracted and collected by the dust collection units 2-1 to 2-8. Therefore, when air, etc., is introduced into the chamber 100 from the introduction port 111 and exhausted from the exhaust port 112, such a situation that particles are stirred up by a wind pressure of the air and widely scatter inside the chamber 100 does not occur.

On the display unit 40 of the capacitance measurement unit 4, when it is visually confirmed that particles attracted to the dust collection units 2-1 to 2-8 have exceeded a reference value, the attached particles can be removed at one time by turning the power supply unit 3 off.

That is, particles on the floor portion 101, etc., which cannot be collected by a conventional dust collection method can be collected. In addition, only when necessary, the particle removal operation can be performed at one time, so that the maintenance operation does not need to be periodically performed. As a result, maintenance costs can be reduced and production efficiency can be improved.

Second Embodiment

Next, a second embodiment of the present invention will be described.

FIG. 6 is a configuration diagram showing a particle collector system according to a second embodiment of the present invention, and FIG. 7 is a sectional view for describing a function of the particle collector system.

As shown in FIG. 6, in the particle collector system 1-2 of this embodiment, the structure of the dust collection unit 2 is different from that of the foregoing first embodiment.

In detail, the dust collection unit 2 is configured by covering the entirety of a tabular first electrode 21 by a dielectric body 20 and affixing a meshed second electrode 22 to the surface of the dielectric body 20.

Then, the input and output terminal 3*a* of the power supply unit 3 is connected to a terminal 21*a* of the tabular first electrode 21, and the input and output terminal 3*b* is connected to a terminal 22*a* of the meshed second electrode 22. In addition, the detection terminal 4*a* of the capacitance measurement unit 4 is connected to the terminal 21*a* of the first electrode 21, and the detection terminal 4*b* is connected to the terminal 22*a* of the second electrode 22.

The input and output terminal 3*b* is grounded inside the power supply unit 3 so that a current does not flow in the meshed second electrode 22.

With this configuration, as shown in FIG. 7, particles P are attracted to the surface of the dielectric body 20 by an electrostatic force of the first and second electrodes 21 and 22. Further, these particles P are captured inside the meshes 22*b* of the meshed second electrode 22.

That is, the particle collector system 1-2 of this embodiment electrically and mechanically captures particles P, so that its performance of capturing particles P is high.

Other configurations, operation and effects are the same as those of the foregoing first embodiment. Thus, their descriptions are omitted.

Third Embodiment

Next, a third embodiment of the present invention will be described.

FIG. 8 is a configuration diagram showing a particle collector system according to a third embodiment of the present invention, and FIG. 9 is a plan view showing a state where the dust collection unit 2 is developed.

As shown in FIG. 8, the particle collector system 1-3 of this embodiment is different from the foregoing embodiment in that the dust collection unit 2 is folded into a honeycomb shape.

In detail, as shown in FIG. 9, a belt-shaped dust collection unit 2 is formed by juxtaposing long-length first and second electrodes 21 and 22 on the lower layer resin sheet 20*a* of the dielectric body 20, and affixing the upper layer resin sheet 20*b* onto the lower layer resin sheet 20*a* so as to cover these first and second electrodes 21 and 22. Then, the input and output terminal 3*a* of the power supply unit 3 is connected to the terminal 21*a* of the first electrode 21, and the input and output terminal 3*b* is connected to the terminal 22*a* of the second electrode 22. In addition, the detection terminal 4*a* of the capacitance measurement unit 4 is connected to the terminal 21*a* of the first electrode 21, and the detection terminal 4*b* is connected to the terminal 22*a* of the second electrode 22.

Thereafter, by folding the belt-shaped dust collection unit 2, the dust collection unit 2 is entirely formed into a three-dimensional honeycomb shape as shown in FIG. 8.

In a state where the dust collection unit 2 is stood up, by turning the power supply unit 3 on, particles around are attracted to the large surface of the dust collection unit 2 and captured inside the tubular cells 23.

Other configurations, operation and effects are the same as those of the foregoing first and second embodiments. Thus, their descriptions are omitted.

Fourth Embodiment

Next, a fourth embodiment of the present invention will be described.

FIG. 10 is a schematic view showing a dust collection unit 2 as an essential portion of a particle collector system according to a fourth embodiment of the present invention.

As shown in FIG. 10(*a*), in the particle collector system 1-4 of this embodiment, one dust collection unit 2 is affixed to the entire surface of a base material 10 having a wavelike surface 11.

With this configuration, the entire surface of the dust collection unit 2 is wavelike so as to follow the surface 11 of the base material 10, so that the particle attraction area becomes larger.

In addition, as shown in FIG. 10(*b*), it is a matter of course that the same operation and effects as those of the particle collector system 1-4 shown in FIG. 10(*a*) are also obtained by affixing a plurality of dust collection units 2-1 to 2-*n* (n=an integer of 2 or more) to the entire surface of the wavelike base material 10.

Other configurations, operation and effects are the same as those of the foregoing first to third embodiments. Thus, their descriptions are omitted.

Fifth Embodiment

Next, a fifth embodiment of the present invention will be described.

FIG. 11 is a configuration diagram of a particle collector system according to a fifth embodiment of the present invention.

As shown in FIG. 11, the particle collector system 1-5 of this embodiment is different from the foregoing embodiments in that the dust collection unit 2 is folded into a meandering shape.

In detail, the dust collection unit 2 is formed into a belt shape as in the case of the third embodiment, and this dust collection unit 2 is folded into a meandering shape and erected on the base material 10. Then, the power supply unit 3 and the capacitance measurement unit 4 are electrically connected to terminals 21*a* and 22*a* of first and second electrodes 21 and 22 of the dust collection unit 2.

Other configurations, operation and effects are the same as those of the foregoing first to fourth embodiments. Thus, their descriptions are omitted.

It is noted that the present invention should not be limited to the foregoing embodiments, and various modifications and changes can be made within the scope of the gist of the invention.

For example, in the foregoing embodiment, an example in which the particle collector system 1-1 of the first embodiment is applied as a dust collection method is shown, however, as a matter of course, the particle collector systems 1-2 to 1-5 of the second to fifth embodiments can also be applied.

In addition, in the foregoing first embodiment, as shown in FIG. 5, an example in which the dust collection units 2-1 to 2-8 are connected in parallel to one power supply unit 3 and one capacitance measurement unit 4 is shown, however, as a matter of course, it is also possible that the dust collection units 2-1 to 2-8 are connected in parallel to one power supply unit 3, and eight capacitance measurement units 4 are provided for the dust collection units 2-1 to 2-8, and one capacitance measurement unit 4 is directly connected to one dust collection unit 2-1 (2-2, . . . , or 2-8).

REFERENCE SIGNS LIST

1-1 to 1-5: Particle collector system
2, 2-1 to **2-*n***: Dust collection unit
3: Power supply unit
**3*a*, 3*b***: Input and output terminal
4: Capacitance measurement unit
**4*a*, 4*b***: Detection terminal
10: Base material
11: Surface
20: Dielectric body
**20*a*, 20*b***: Resin sheet
21: First electrode
**21*a*, 22*a***: Terminal
22: Second electrode
**22*b***: Mesh
23: Cell
40: Display unit
100: Chamber
101: Floor portion
102: Ceiling portion
103: Wall portion
111: Introduction port
112: Exhaust port
120: Stage
121: Lift pin
122: Upper device
P: Particle
W: Work

The invention claimed is:

1. A particle collector system comprising:

a sheet-shaped and flexible dust collection unit that attracts particles by an electrostatic force;

a power supply that supplies power to the dust collection unit to generate an electrostatic force; and a capacitance measurement unit that measures a capacitance of the dust collection unit which varies according to an amount of particles attracted to the dust collection unit, wherein the dust collection unit has at least one of a honeycomb shape, a wave-like shape, and a meandering shape and includes a first electrode, a second electrode, and a dielectric body, wherein each of the first and second electrodes has a length longer than a width, the lengths of the first and second electrodes being juxtaposed side-by-side and extending contiguously in the at least one of the honeycomb shape, the wave-like shape, and the meandering shape of the dust collection unit, wherein the dielectric body entirely covers the first and second electrodes, wherein the power supply unit supplies predetermined power supply voltages to the first and second electrodes, and wherein the capacitance measurement unit measures a capacitance between the first and second electrodes.

2. The particle collector system according to claim 1, wherein one side of the sheet-shaped dust collection unit is affixed to a base material.

3. The particle collector system according to claim 1 wherein one edge of the meandering shape of the dust collection unit stands on a base material.

4. The particle collector system according to claim 1, wherein the dust collection unit is provided on a surface inside a chamber, and the power supply unit and the capacitance measurement unit are disposed outside the chamber.

* * * * *